US008783917B2

(12) United States Patent
Mrakovich

(10) Patent No.: US 8,783,917 B2
(45) Date of Patent: Jul. 22, 2014

(54) LED RETROFIT MODULE FOR ROADWAY FIXTURE

(75) Inventor: Matthew Steven Mrakovich, Valley View, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 107 days.

(21) Appl. No.: 12/979,515

(22) Filed: Dec. 28, 2010

(65) Prior Publication Data

US 2012/0162980 A1 Jun. 28, 2012

(51) Int. Cl.
*F21S 8/00* (2006.01)

(52) U.S. Cl.
USPC ..... 362/427; 362/249.02; 362/217.14; 362/217.16; 362/430; 362/431

(58) Field of Classification Search
USPC ..... 362/217.01–217.17, 249.02, 427–431
See application file for complete search history.

(56) References Cited

U.S. PATENT DOCUMENTS

| | | | | |
|---|---|---|---|---|
| 7,434,959 | B1 * | 10/2008 | Wang | 362/249.01 |
| 8,310,158 | B2 * | 11/2012 | Coplin et al. | 315/32 |
| 2007/0253198 | A1 * | 11/2007 | Pelegrin | 362/246 |
| 2010/0134046 | A1 * | 6/2010 | Holder et al. | 315/297 |
| 2010/0309664 | A1 * | 12/2010 | Liu et al. | 362/235 |
| 2011/0134239 | A1 * | 6/2011 | Vadai et al. | 348/143 |

FOREIGN PATENT DOCUMENTS

WO WO 2010/028509 3/2010

OTHER PUBLICATIONS

EcoFit Lighting brochure, www.ecofitlighting.com, 3 pages, 2009.

* cited by examiner

*Primary Examiner* — Sean Gramling
(74) *Attorney, Agent, or Firm* — Fay Sharpe LLP

(57) ABSTRACT

A solid state replacement light module for a high intensity discharge light fixture. The module is comprised of an elongated generally planar body having a first side including a plurality of light emitting diodes and a second side including a plurality of heat dissipating fins. The second side further includes an electronic module. The body also includes a hinge mechanism suitable for attachment to the light fixture.

18 Claims, 5 Drawing Sheets

LED RETROFIT MODULE FOR ROADWAY FIXTURE

BACKGROUND

Exterior lighting is used to illuminate roadways, parking lots, yards, sidewalks, public meeting areas, signs, work sites, and buildings, to name a few examples. Traditionally, such lighting systems used high-intensity discharge (HID) lamps, often high pressure sodium (HPS) lamps. The move towards improved energy efficiency has brought to the forefront light emitting diode (LED) technology as an alternative to HID lighting in commercial and municipal applications. LED lighting has the potential to provide improved energy efficiency and improved light output in outdoor applications.

The Cobra Head type light fixture is perhaps the most commonly found style of roadway fixture. It would be advantageous to convert existing Cobra Head style HID lamps to LED light sources without having to discard the entire fixture assembly. There is therefore a need for an improved LED retrofit solution for outdoor applications that does not require replacement of the existing fixture.

With reference to FIG. 1, a typical roadway lighting fixture is depicted. The Cobra Head lighting fixture 1 comprises a housing 3 having a central longitudinal axis "L". The housing 3 includes a center section 5 arranged about the center longitudinal axis "L" of the housing 3 and running substantially along one half the length of the longitudinal axis of the housing 3. The center section 5 defines a forward compartment enclosing an HID lamp 7 and a reflector 9. The compartment is accessed via a door (not shown) hinged to a bottom surface of the fixture to provide access to the compartment from below. Typically, the door includes an opening receiving a lens through which light generated by the HID lamp 7 exits the fixture 1. A rear section 11 of the housing 3 defines a rearward compartment housing a power supply 13 such as a ballast. The rear compartment also receives post 15. A second door (not shown) is provided to cover the power supply 13 and provide independent access thereto. Alternatively, a single door is provided which is hingedly connected to the fixture 1 and provides access to center section 5 and rearward section 11 when opened.

According to one available LED retrofit system a replacement LED light source can be installed as follows. First, the door of an existing roadway illuminaire is opened, the existing HID lamp, reflector and lens are removed and recycled. Optionally, the existing ballast and other electrical components can be similarly removed. An LED light engine is then installed into the opening in the door from which the lens was removed. A safety cable is installed between the LED light engine and a main body of the fixture. Power leads are attached between the LED light engine and the power leads of the light fixture. Thereafter, the fixture door is closed and latched to achieve final installation of the LED luminaire. Although functional, this design can suffer from thermal management issues.

The present disclosure is directed to an improved simple and economic LED module for replacement of an HID lamp in an outdoor fixture.

BRIEF DESCRIPTION

According to a first embodiment, a solid state replacement light module for a high intensity discharge light fixture is provided. The module is comprised of an elongated general planar body. The body has a first side including a plurality of light emitting diodes and a second side including an electronics module. The body further includes a means for rotatable attachment to the light fixture.

According to a second embodiment, a method of retrofitting a roadway lamp fixture is described. The method comprises providing an LED inclusive door which is cooperatively shaped and sized relative to an opening in the lamp fixture. The LED inclusive door includes a first side with a plurality of light emitting diodes and a second side including an electronics module. An existing door is removed from the fixture at its hinged connection to the fixture and the LED inclusive door is installed to the fixture at the hinged connection. The electronics module is connected to the fixture power lines.

According to a third embodiment, a method of retrofitting a roadway lamp fixture is provided. The method comprises removing existing roadway lamp, fixture door, removing a lamp and electronics suitable for driving the lamp from the fixture. Further steps include installing electronics suitable for driving a plurality of light emitting diodes, connecting the electronics to a power line within the fixture and installing a door including a plurality of light emitting diodes which is sized substantially the same as the removed existing door. An electrical connection between the electronics suitable for driving the light emitting diodes and the plurality of light emitting diodes is also established.

DETAILED DESCRIPTION

The present disclosure provides a convenient and economical device for the replacement of an HID light source in a light fixture. The disclosure finds particular relevance to roadway fixtures, such as the commonly employed Cobra Head style. Of course, although reference is made herein to the Cobra Head style of fixtures, the LED lighting module described is amenable to other similar types of lighting fixtures.

Figure 1:
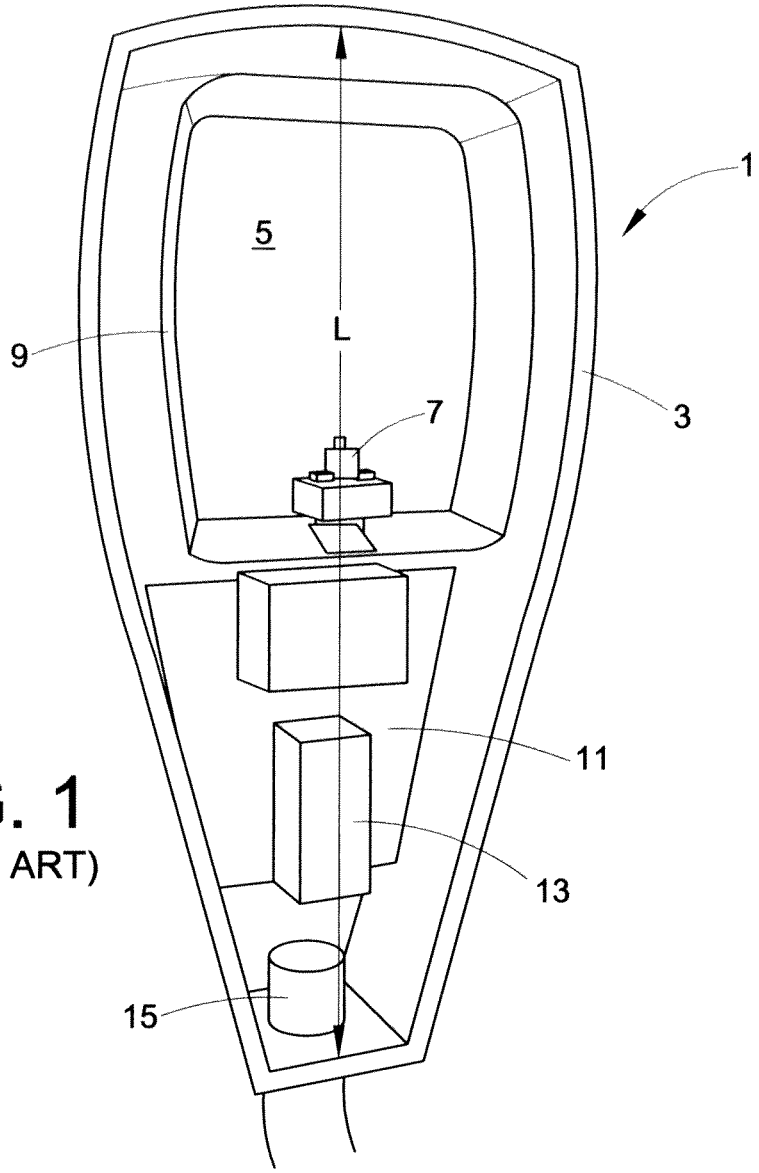
FIG. 1 (PRIOR ART)
FIG. 1 a perspective view of a prior art Cobra Head roadway fixture.
Figure 2:
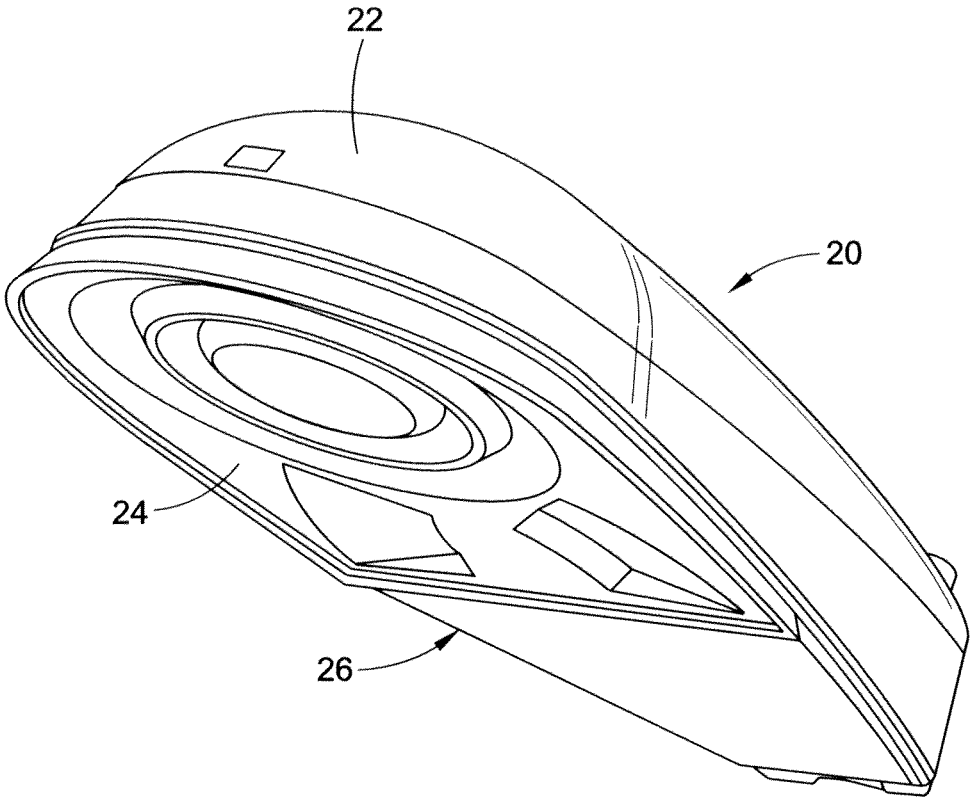
FIG. 2 is a perspective view of a Cobra Head roadway fixture including an LED replacement module.
Figure 7:
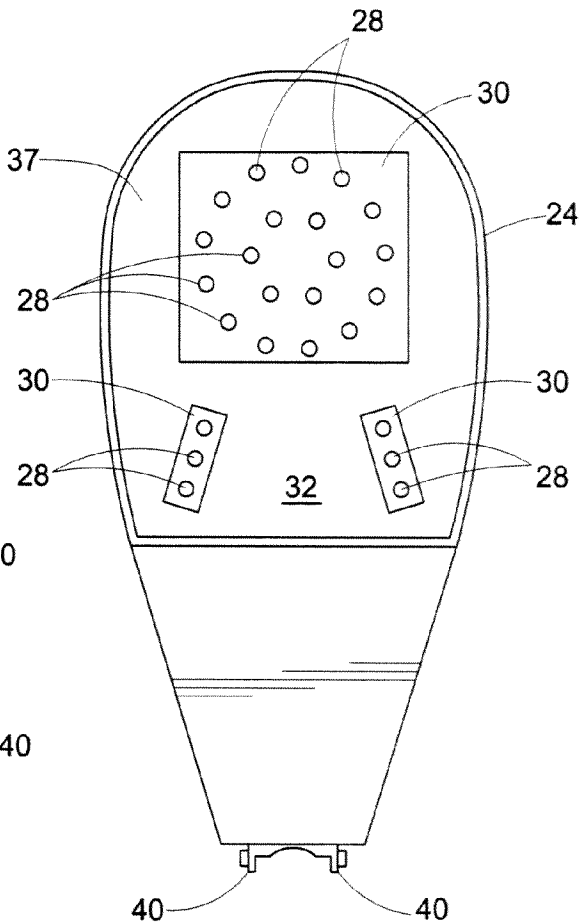
FIG. 7 is a bottom view of the module of FIG. 4 with optical elements 48 and 52 removed.
Figure 3:
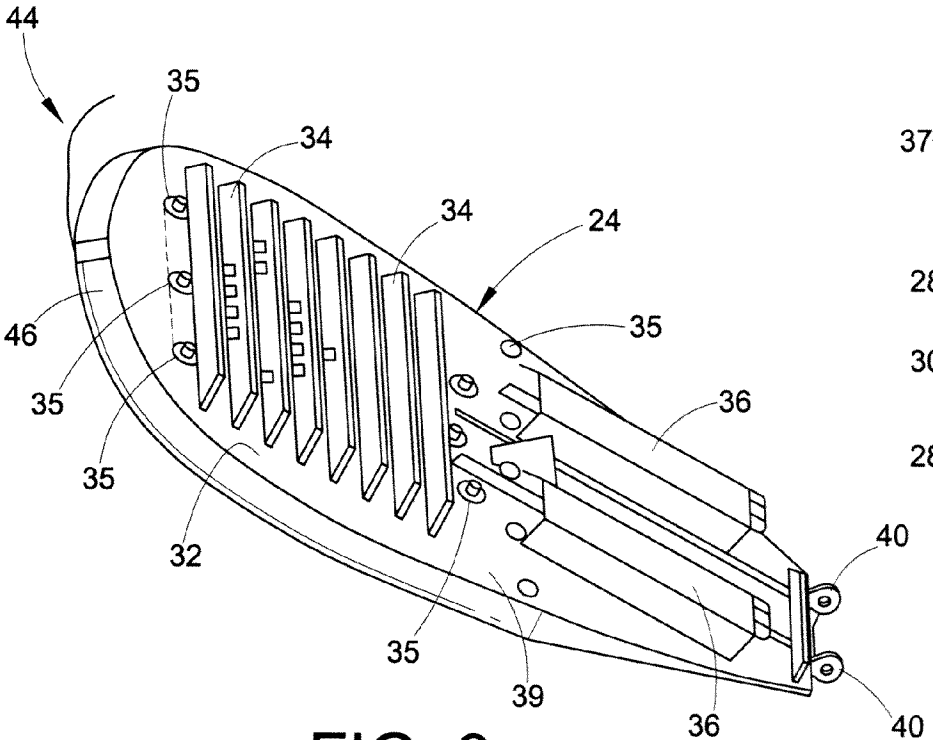
FIG. 3 is a perspective view of the LED replacement module.
Figure 6:
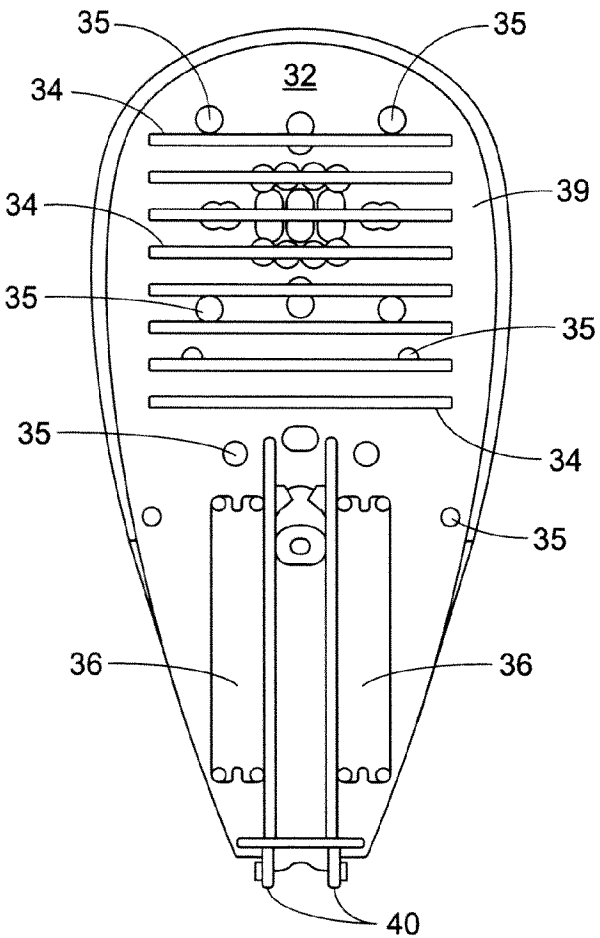
FIG. 6 is a top view of the module of FIG. 3.
Figure 5:
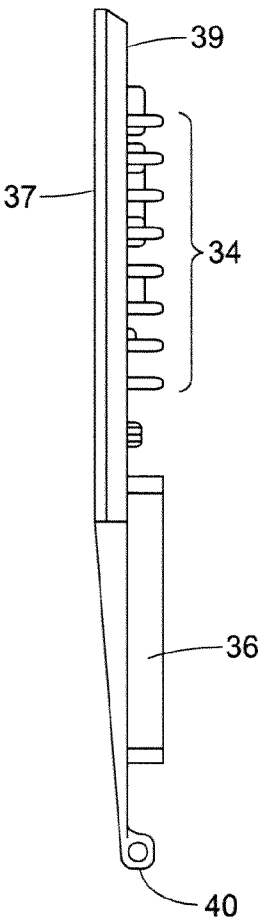
FIG. 5 is a side view of the module of FIG. 3.
Figure 4:
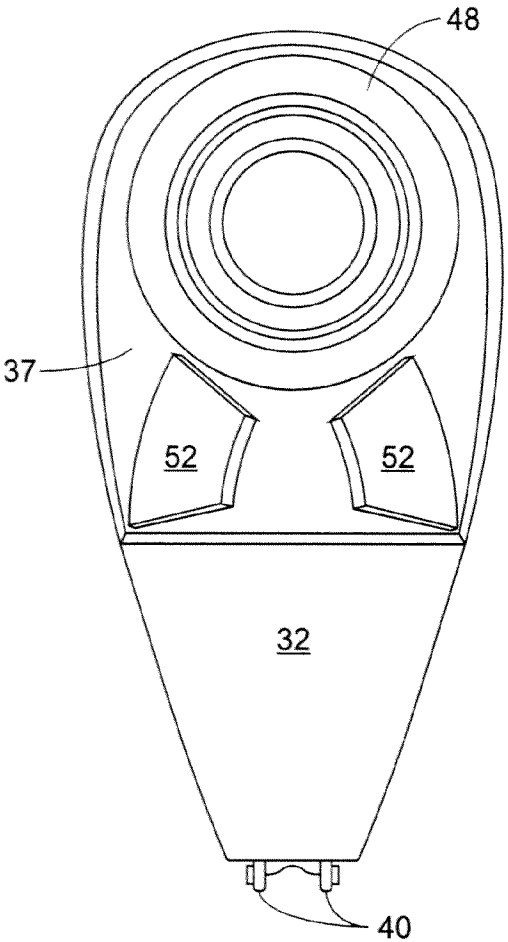
FIG. 4 is a bottom view of the module of FIG. 3.

Referring to FIG. 2, a light fixture 20 including the subject replacement LED light source is depicted. More particularly, a standard roadway light fixture 20 including a main housing 22 has been modified to include an LED lighting module 24. In this regard, the perimeter of the LED lighting module 24 is shaped cooperatively to base opening 26 of the main housing 22.

Referring now to FIGS. 3-7, the present disclosure provides a light engine module 24 including a plurality of LEDs 28 disposed on a printed circuit board 30. The LEDs can emit in combination at least 1500 lumens. Printed circuit boards 30 are mounted to and in thermal communication with elongated and substantially planar body 32. Body 32 is provided with a plurality of hollow bosses 35 which receive screws (not shown) that facilitate mounting printed circuit board(s) 30 to body 32. In this manner, through holes between outboard side 37 of body 32 and inboard side 39 can be avoided. Preferably, body 32 is comprised of a cast metal having a high thermal conductivity to facilitate heat dissipation via spreading throughout the entire roadway lighting fixture 20. A plurality of heat dissipating fins 34 are also provided to enhance heat dissipation by increasing surface area.

Electronics modules 36 are provided to facilitate the conversion of alternating current to DC current for powering of the LEDs 28. The light engine module 24 is provided with a pair of tabs 40 which facilitate the attachment to a hinge element on the existing main fixture housing 22. Moreover, cooperative tabs or a recess on the main fixture housing 22 can receive tabs 40 and be joined together via a post pin or other element.

A clip element 44 may be provided at end 46 of the light engine module 26 to permit selective rotatable mating to light fixture 20 and retain the module in a closed position. Alternatively, if the original HID fixture includes a clip on the main housing 22, it is envisioned that original clip can be utilized to retain the replacement LED module 24.

Alternative means for joining the light engine module 24 to fixture main housing 22 can include a spring, strap, hinge, hook or other mechanical joinder which allows sufficient rotation to open the LED lighting module.

An optic 48 is provided on the outboard side 37 of body 32. Optic 48 overlays the LEDs 28 and facilitates transmission of a desired light pattern. Optical elements 52 are additional reflectors that direct light outwardly at a relativity higher orientation to direct light between adjacent poles. If poles are relatively close, the additional light elements 52 may be unnecessary. Nonetheless it is considered advantageous to provide multiple LED arrays having different focal points to provide light on different targets.

Figure 8:
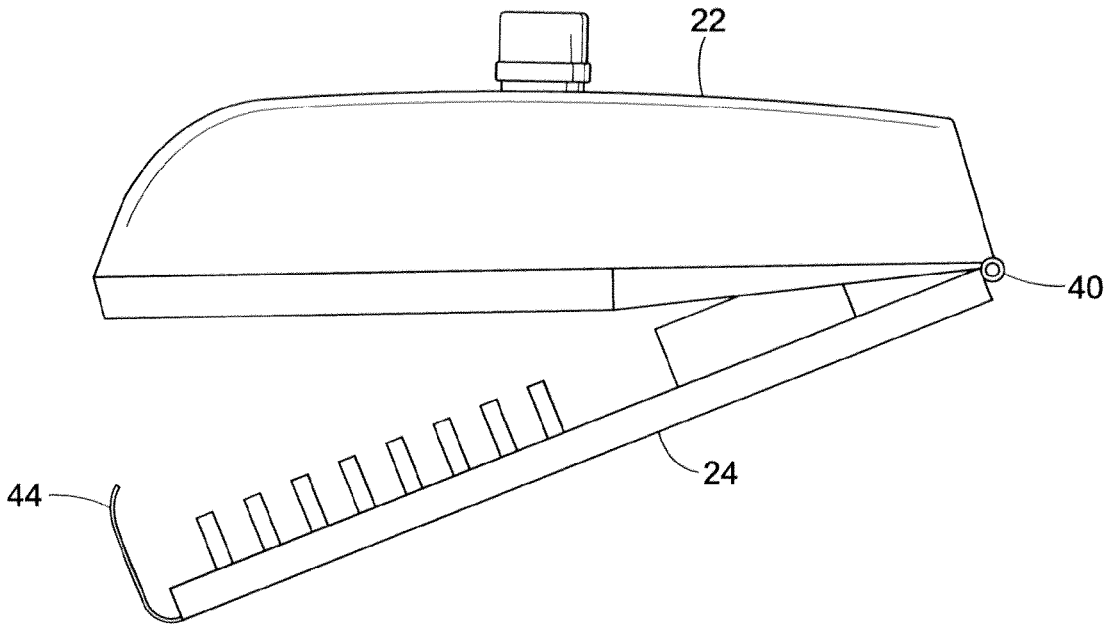
FIG. 8 is a side elevation view of the fixture of FIG. 2 with the module door open.

Referring now to FIG. 8, by removing the forward compartment door, the rearward compartment door and the internal HID components and attaching the LED lighting module to the hinge elements used in association with the rearward component door, the bottom section of the lighting fixture 20 is replaced in its entirety with an LED light module 24. This solution is similarly employed when the entire base of the HID light fixture is closed by a single door providing access to the HID lamp and the ballast components.

Advantageously, the present retrofit solution creates a light fixture having excellent heat sinking for LED generated heat as LED lighting module 24 is a large mass body which is in thermal communication with main fixture housing 22. The present LED replacement module can be a complete retrofit module to convert a traditional roadway light fixture from an HID light source to an LED light source by removing the electrics door, the optical door, and associated brackets and replacing them with a complete LED module that fits the existing housing as an integral replacement door. The assembly can be in the form of combined optical door/power door to be separated into two distinct assemblies.

The assembly enables easy field conversion of HID roadway fixtures to LED. By integrating, the LED optical system and power electronics into a single retrofit door assembly, the conversion to LED would be quick, low cost and have good thermal performance.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A solid state replacement light module for a high intensity discharge light fixture comprised of a housing, said module comprised of an elongated generally planar metal body, said body having a first side including a plurality of light emitting diodes and a second side including a plurality of integral heat dissipation fins, an electronics module, said body further including a pair of tabs defining passages adapted to receive a post and provide rotatable attachment to said housing, said pair of tabs disposed at a first end of said body, and a retaining clasp for attachment to said housing disposed at an opposed end of the body.

2. The light module of claim 1 wherein said body is comprised of a cast metal.

3. A solid state replacement light module for a high intensity discharge light fixture comprised of a housing, said module comprised of a cast elongated generally planar metal body, said body having a first side including a plurality of light emitting diodes and a second side including a plurality of heat dissipation fins integrally cast with the planar metal body, an electronics module, said body further including a means for rotatable attachment to said housing which is integrally cast with the planar metal body, said means for rotatable attachment comprising a pair of tabs including passages adapted to receive a post disposed at a first end of said body and a retaining clasp for attachment to said housing disposed at an opposed end of the body.

4. The module of claim 3 wherein said light emitting diodes reside on a printed circuit board in thermal communication with said body.

5. The module of claim 3 further including an optic overlaying said light emitting diodes on the first side of said body.

6. The module of claim 3 wherein said body includes a first region receiving said light emitting diodes and a second narrower region receiving said means for rotatable attachment.

7. The module of claim 6 wherein said second narrower region further receives said electronics module.

8. The module of claim 3 wherein said light fixture comprises a Cobra Head style.

9. The module of claim 4 further including at least three light emitting diode inclusive printed circuit boards.

10. The module of claim 3 wherein said light emitting diode in combination emit at least 1500 lumens.

11. The module of claim 3 wherein said fins are generally perpendicular to a longitudinal axis extending in the elongated dimension of said body.

12. The module of claim 4 wherein said body further includes a plurality of integral bosses protruding from said body disposed to receive screws for mounting said printed circuit board to said body.

13. The module of claim 3 further comprising at least two light emitting diode arrays having different focal points, a first array having a substantially circular distribution of light emitting diodes and a second array having a substantially linear distribution of light emitting diodes.

14. The light module of claim 3 wherein said housing comprises a substantially hollow shell.

15. The light module of claim 3 wherein said module forms at least substantially the entire bottom surface of the light fixture.

16. A method of retrofitting a high intensity discharge roadway lamp fixture, said method comprising providing an LED inclusive metal door which is cooperatively shaped and sized relative to an opening in said lamp fixture, said LED inclusive door comprising a first side through which a plurality of light emitting diodes emit light and a second side including an electronics module, said light emitting diodes and said electronics module being in thermal communication with said LED inclusive door, removing an existing electronics door and an existing optical door from said fixture, the electronics door being removed at its hinged connection with said fixture, attaching said LED inclusive door to said fixture at said hinged connection, and connecting said electronics module to fixture power lines.

17. The method of claim 16 wherein said lamp fixture comprises a Cobra Head style.

18. The method of claim 17 wherein said LED inclusive door includes an elongated longitudinal axis, and a first region receiving said light emitting diode, having a first width and a second region receiving said hinged connection having a second narrower width.

* * * * *